US005711319A

United States Patent [19]

Cumner

[11] Patent Number: 5,711,319

[45] Date of Patent: Jan. 27, 1998

[54] DRY ICE EXPANDED TOBACCO

[75] Inventor: Clive Stewart Cumner, Surrey, United Kingdom

[73] Assignee: Messer UK Limited, Surrey, United Kingdom

[21] Appl. No.: 687,523

[22] PCT Filed: Jan. 19, 1995

[86] PCT No.: PCT/GB95/00102

§ 371 Date: Oct. 10, 1996

§ 102(e) Date: Oct. 10, 1996

[87] PCT Pub. No.: WO95/21545

PCT Pub. Date: Aug. 17, 1995

[30] Foreign Application Priority Data

Feb. 9, 1994 [GB] United Kingdom ..... 9402473

[51] Int. Cl.[6] ..... A24B 3/18

[52] U.S. Cl. ..... 131/291; 131/296; 131/900

[58] Field of Search ..... 131/294, 900, 131/291, 296

[56] References Cited

U.S. PATENT DOCUMENTS

Re. 32,014 10/1985 Sykes et al. ..... 131/291

FOREIGN PATENT DOCUMENTS 0 500 226 A1 8/1992 European Pat. Off. ..... 131/291

0 514 860 A2 11/1992 European Pat. Off. ..... 131/291

0 565 246 A2 10/1993 European Pat. Off. ..... 131/291

2 259 546 8/1975 France ..... 131/291

*Primary Examiner*—Vincent Millin

*Assistant Examiner*—Charles W. Anderson

*Attorney, Agent, or Firm*—Sughrue, Mion, Zinn, Macpeak & Seas, PLLC

[57] ABSTRACT

In a process for expanding tobacco, an equilibrium pressure within a process vessel (1) containing a mixture of gaseous carbon dioxide and liquid carbon dioxide is selected before charging a sample volume of tobacco from a batch of tobacco into a sealable impregnator vessel (2). Liquid carbon dioxide is then transferred at the selected equilibrium pressure from the process vessel (1) into the impregnator vessel (2) where it is maintained sufficiently long to permit liquefied carbon dioxide to penetrate the cells of the tobacco. Liquid carbon dioxide is subsequently transferred from the impregnator vessel (2) into a drain vessel (3) and the pressure within the impregnator vessel (2) is reduced sufficiently to cause the solidification of liquid carbon dioxide contained within the cells of the tobacco. Finally, the tobacco is heated sufficiently to vaporise the carbon dioxide in the tobacco cells thereby expanding the tobacco. The degree of tobacco expansion obtained is determined and the equilibrium pressure within the process vessel (1) is re-selected to control the amount of solid carbon dioxide formed during the de-pressurisation step of a subsequent impregnation cycle or cycles to optimise the degree of expansion of tobacco for the remainder of the batch.

18 Claims, 1 Drawing Sheet

DRY ICE EXPANDED TOBACCO

TECHNICAL FIELD

The present invention relates to the expansion of tobacco using carbon dioxide.

BACKGROUND ART

In a dry ice expanded tobacco, or D.I.E.T., process currently in operation at a tobacco expansion plant in Corby, England, tobacco is firstly loaded into an impregnator vessel which is subsequently sealed. The atmosphere within the impregnator vessel is then purged with low pressure gaseous carbon dioxide obtained from a charge vessel. Once all the air has been forced out of the impregnator vessel via a vent to atmosphere the vent is closed and the impregnator vessel is pressurised by gaseous carbon dioxide initially from the charge vessel and subsequently from a process vessel containing an equilibrium mixture of gaseous carbon dioxide and liquid carbon dioxide. The impregnator vessel is then re-connected to the charge vessel and simultaneously, the impregnator vessel is connected to the liquid carbon dioxide phase within the process vessel and the pressure difference which exists between the process vessel and the charge vessel causes liquid carbon dioxide to be transferred from the process vessel into the impregnator vessel to totally immerse the tobacco in liquid carbon dioxide.

Once the liquid carbon dioxide level within the impregnator vessel has reached a pre-determined level the impregnator vessel is isolated from both the charge vessel and the process vessel. The liquid carbon dioxide is maintained within the impregnator vessel sufficiently long to permit liquid carbon dioxide to penetrate into the cells of the tobacco. Following this, the impregnator vessel is reconnected to the process vessel to transfer liquid carbon dioxide which has not been absorbed by the tobacco back into the process vessel under the action of gravity. The impregnator vessel is then once again isolated from the process vessel and a connection established with a recovery system and consequently with a recovery balloon to allow the pressure within the impregnator vessel to reduce to cause the liquid carbon dioxide within the tobacco cells to solidify. Gaseous carbon dioxide from the impregnator vessel is collected and returned to the process vessel via the gas recovery system which reliquefies the gas. The impregnator vessel is then opened to allow the frozen tobacco to fall out and finally the tobacco is heated within a sublimator to cause the solid carbon dioxide within the tobacco cells to vaporise rapidly thereby expanding the tobacco.

The operation of the Corby plant relies on the transfer of liquid carbon dioxide from the process vessel to the impregnator vessel by means of the differential pressure which is maintained between the process vessel and the charge vessel. There is a delicate balance of pressure between the different parts of the system and consequently this and indeed other processes are designed to operate at a single impregnation pressure, such as 450 psi, which is used to expand all types or blends of tobacco, from any origin, which is sent to the plant. This pressure expands some tobacco product by anything up to two hundred percent whilst only expanding other tobacco product by around thirty to forty percent. The cost of achieving these two quite different degrees of expansion is the same.

DISCLOSURE OF THE INVENTION

According to a first aspect of the present invention, a process for expanding tobacco comprises the steps of:

selecting an equilibrium pressure within a process vessel containing a mixture of gaseous carbon dioxide and liquid carbon dioxide;

charging a sample volume of tobacco from a batch of tobacco into a sealable impregnator vessel;

transferring liquid carbon dioxide at the selected equilibrium pressure from the process vessel into the impregnator vessel;

maintaining the liquid carbon dioxide in the impregnator vessel sufficiently long to permit liquefied carbon dioxide to penetrate the cells of the tobacco;

transferring liquid carbon dioxide from the impregnator vessel;

reducing the pressure within the impregnator vessel sufficiently to cause the solidification of liquid carbon dioxide contained within the cells of the tobacco;

heating the tobacco sufficiently to vaporise the carbon dioxide in the tobacco cells thereby expanding the tobacco;

determining the degree of tobacco expansion obtained; and, re-selecting the equilibrium pressure within the process vessel to control the amount of solid carbon dioxide formed during the de-pressurisation step of a subsequent impregnation cycle or cycles to optimise the degree of expansion of tobacco for the remainder of the batch.

By changing the equilibrium pressure within the process vessel it is possible to optimise the degree of expansion for each batch of tobacco. Whilst it would theoretically be possible to change the operating pressure of the existing plant in Corby to optimise the degree of expansion, to do so requires the complete shutdown of the plant for a considerable period whilst the numerous temperature and pressure sensors are reset to ensure that a sufficient pressure differential can be established between the process vessel and the charge vessel when the plant is operating. In general this option is not commercially attractive.

According to a second aspect of the present invention, an apparatus for expanding tobacco by the process of the first aspect of the invention comprises:

a process vessel containing an equilibrium mixture of liquefied carbon dioxide and gaseous carbon dioxide;

an impregnator vessel having a sealable top lid for charging tobacco into the impregnator vessel and a sealable bottom lid for discharging tobacco from the impregnator vessel;

means providing fluid communication between the gas phase within the process vessel and the impregnator vessel;

means providing fluid communication between the liquid phase within the process vessel and the impregnator vessel;

a drain vessel;

means providing fluid communication between the impregnator vessel and the drain vessel for transferring liquid carbon dioxide from the impregnator vessel to the drain vessel;

means providing fluid communication between the drain vessel and the process vessel for transferring liquid carbon dioxide from the drain vessel to the process vessel;

means for selecting an equilibrium pressure within the process vessel; and, means for controlling the pressure within the process vessel to establish the selected equilibrium pressure.

Tobacco is an extremely complex natural product and tobacco received at a tobacco expansion plant invariably varies in quality in terms of the sugar content, the moisture content, the particular blend of stem and lamina material, the manner in which the tobacco has been pre-cut and the general susceptibility of the tobacco to dry ice expansion.

Accordingly, for any given impregnation pressure, one batch of tobacco will expand by anything up to two hundred percent, whilst another batch, even from the same source, may only expand by thirty to forty percent. In the present invention, the impregnation pressure most suitable for expanding a batch of tobacco is determined and subsequently the remainder of the batch is processed at that impregnation pressure. To achieve this, the tobacco processing plant must be readily capable of operating at different selected impregnation pressures without adversely affecting the overall efficiency of the plant in terms of throughput whilst changing the equilibrium pressure within the process vessel.

As explained above, the plant at Corby is not capable of achieving this as the relationship of the pressure in the process vessel is closely linked to that within the charge vessel. In particular, in the existing plant, the equilibrium pressure within the process vessel cannot be lowered readily as then there would not be a sufficient pressure differential between the process vessel and the charge vessel to effect the transfer of liquid carbon dioxide from the process vessel to the impregnator vessel.

In a D.I.E.T. process, when the pressure within the impregnator vessel is reduced to the triple point of carbon dioxide, the liquid within the tobacco and elsewhere will change its state into solid carbon dioxide and gaseous carbon dioxide. The percentage of solid to gas is a function of the heat content of the carbon dioxide liquid. An initially colder liquid will produce a higher percentage of solid than will an initially warmer liquid once the pressure has fallen below the triple point. In the present invention by operating the system at high or low equilibrium pressures, i.e. at high or low liquid carbon dioxide temperatures, it is possible to adjust the amount of solid carbon dioxide produced within the impregnator and hence within the cells of the tobacco. Clearly, the greater the amount of liquid carbon dioxide held within the tobacco cells which is converted to solid carbon dioxide, the greater will be the degree of expansion of the tobacco when it passes through the sublimator.

According to a third aspect of the present invention, a method of purging air from within an impregnator vessel used in a process for expanding tobacco comprises the steps of:

pressurising the impregnator vessel with carbon dioxide gas from a process vessel containing an equilibrium mixture of liquefied carbon dioxide and gaseous carbon dioxide;

transferring liquid carbon dioxide into the impregnator vessel from the process vessel; and, venting a mixture of air and carbon dioxide gas from the impregnator vessel as the level of liquid carbon dioxide within the impregnator vessel rises.

As explained above, in the existing Corby plant, air is purged from the impregnator vessel by blowing gaseous carbon dioxide from the charge vessel through the impregnator vessel and venting to atmosphere. This purge cycle requires a volume of carbon dioxide which equates to approximately four times the volume of the impregnator vessel as the process relies on the dilution of the air by the carbon dioxide. This uses valuable cycle time and of course wastes carbon dioxide. In the third aspect of the present invention, this purge cycle is dispensed with and instead, once the impregnator vessel is pressurised by the gas from within the process vessel to contain a high pressure mixture of air and carbon dioxide, the rising level of liquid transferred from the process vessel is utilised as a "liquid piston" to drive the mixture of air and carbon dioxide out of the impregnator vessel with very little further dilution of the mixture.

Preferably, the arrangement of the apparatus is such that liquid carbon dioxide may be transferred from the process vessel into the impregnator vessel under the action of gravity and subsequently liquid carbon dioxide may be transferred from the impregnator vessel into the drain vessel also under the action of gravity. The liquid carbon dioxide within the drain vessel may be returned to the process vessel for subsequent re-use by a low pressure transfer pump. More preferably, high pressure carbon dioxide is introduced into the drain vessel to displace the liquid carbon dioxide from the drain vessel back up to the process vessel.

Preferably, the drain vessel is connected to a carbon dioxide reservoir which is capable of providing the differential pressure required to displace liquid carbon dioxide from the drain vessel back up to the process vessel. Preferably, the carbon dioxide reservoir is supplied with carbon dioxide which has been recovered following the venting of carbon dioxide from the impregnator vessel during the de-pressurisation step which causes the solidification of liquid carbon dioxide within the cells of the tobacco.

Preferably, the carbon dioxide reservoir may also be connected to the impregnator vessel to assist in the transfer of liquid carbon dioxide from the impregnator vessel to the drain vessel.

Preferably, the equilibrium pressure within the process vessel is controlled by refrigeration means which alters the pressure to establish the pre-selected equilibrium pressure. Preferably, the process operates within a range of pressures from 195 to 450 psi.

Once the volume of tobacco has been loaded into the impregnator vessel the impregnator vessel is sealed and subsequently pressurised with gaseous carbon dioxide obtained from the gas phase of the process vessel. Following this, in accordance with the third aspect of the present invention, liquid carbon dioxide is transferred from the process vessel to the bottom of the impregnator vessel. As the level of liquid within the impregnator vessel rises the mixture of carbon dioxide gas and air within the impregnator vessel is displaced from the impregnator vessel along with additional carbon dioxide which is vapourised on contact with the warm tobacco. The displaced gas mixture may be transferred to a gas recovery system which recovers the carbon dioxide and vents the non-liquefiable air to atmosphere. The recovered carbon dioxide is then compressed and fed into the carbon dioxide reservoir and/or re-liquefied prior to return to the process vessel. More preferably, the mixture of carbon dioxide and air is vented directly to the process vessel and the non-liquefiable air automatically vented to atmosphere from the process vessel. In this manner, air may be purged from within the impregnator vessel to leave only liquid carbon dioxide and gaseous carbon dioxide within the impregnator vessel.

The carbon dioxide gas discharged from the impregnator vessel during the de-pressurisation step may be collected within a carbon dioxide recovery balloon. In this case, the gas within the recovery balloon is compressed and re-liquefied and returned to the process vessel. The carbon dioxide reservoir is re-charged with carbon dioxide gas directly from the compressor.

Alternatively, carbon dioxide gas discharged from the impregnator vessel during the de-pressurisation step is collected within an intermediate pressure vessel which conserves the pressure of a portion of the vented gas, the remainder being discharged to the recovery balloon. Preferably, a compressor is provided to transfer gas from the recovery balloon to the intermediate pressure vessel and a second compressor is used to transfer gas to a heat exchanger. Re-liquefied carbon dioxide from the heat exchanger is then returned to the process vessel. The gas to re-charge the reservoir with carbon dioxide is obtained directly from the second compressor.

Preferably, liquid carbon dioxide is always transferred via the bottom of each of the process vessel and drain vessel to ensure that tobacco products extracted by the liquid carbon dioxide during impregnation remain in solution or suspension. This prevents tobacco products from being deposited on the walls of the process vessel or drain vessel and ensures that the liquid carbon dioxide is substantially saturated with tobacco products to reduce the removal of any such products from the tobacco which is being expanded. Preferably, both the process vessel and drain vessel are generally cylindrical in shape with a conical base portion and are orientated in the vertical sense.

BRIEF DESCRIPTION OF THE DRAWINGS

The present invention will now be described in detail, with reference to the accompanying drawing, which shows one example of a system for impregnating tobacco with carbon dioxide.

BEST MODE FOR CARRYING OUT THE INVENTION

Figure 1:
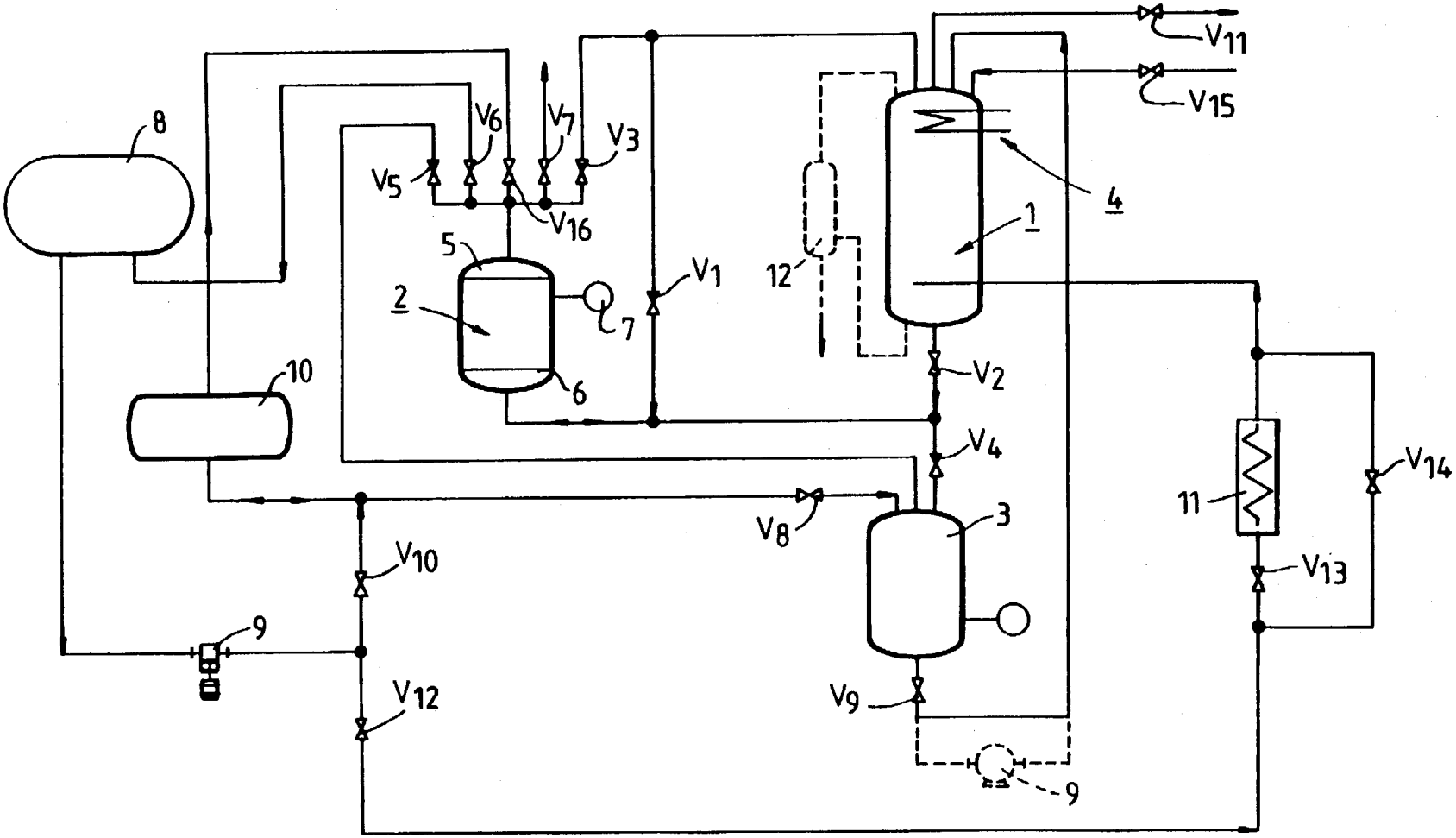

The tobacco expansion system shown in FIG. 1 comprises a process vessel 1, an impregnator vessel 2 and a drain vessel 3. The process vessel 1 contains a substantially equilibrium mixture of liquid carbon dioxide and gaseous carbon dioxide. The process vessel 1 includes a refrigeration coil 4 to control the pressure within the process vessel 1. Typically, the process vessel equilibrium pressure will be controlled within a range of 195 to 450 psi.

The impregnator vessel 2 is positioned below the process vessel 1 and the drain vessel 3 is positioned below the impregnator vessel 2. The impregnator vessel 2 comprises a sealable top lid 5 and a sealable bottom lid 6.

In use, a volume of tobacco from a batch of tobacco is charged into the impregnator vessel 2 via the top lid 5 which is subsequently sealed. Once the top lid 5 has been sealed the impregnator vessel 2 is pressurised from the gas phase of the process vessel 1 via valve $V_1$. Valve $V_1$ is then closed and valves $V_2$ and $V_3$ are opened. This allows liquid carbon dioxide contaminated with tobacco products from earlier impregnation cycles to be transferred from the process vessel 1 into the impregnator vessel 2 by means of gravity. A mixture of air and carbon dioxide gas, including carbon dioxide gas vapourised when the liquid carbon dioxide contacts the tobacco, is displaced from the impregnator vessel 2 into the process vessel 1 via the valve $V_3$ as the liquid level within the impregnator 2 rises, i.e. a liquid piston effect. When the liquid level within the impregnator vessel 2 has risen to the required level detected by liquid level detector 7, the valves $V_2$ and $V_3$ are closed. Alternatively, the impregnator may be pressurised vial valve $V_3$ in which case $V_1$ is unnecessary, if in practice there is no compaction of tobacco by so doing.

Liquid carbon dioxide is maintained within the impregnator vessel 2 sufficiently long to permit liquid carbon dioxide to penetrate into the cells of the tobacco. Subsequently, the valves $V_4$ and $V_5$ are opened to allow liquid carbon dioxide not held by the tobacco to drain from the impregnator vessel 2 into the drain vessel 3, again by means of gravity. After a suitable period, the valve $V_5$ is closed and valve $V_{16}$ is opened to connect a carbon dioxide pressure reservoir 10 to the top of the impregnator vessel 2. The pressurized carbon dioxide from the pressure reservoir 10 completes the transfer of the liquid carbon dioxide from the impregnator vessel 2 to the drain vessel 3 and the valves $V_4$ and $V_{16}$ are subsequently closed. The valve $V_6$ is then opened to de-pressurise the impregnator vessel 2 by venting gaseous carbon dioxide to a gas recovery balloon 8. Gas within the recovery balloon 8 is re-compressed using compressor 9.

When the pressure in the impregnator vessel has fallen to a level close to atmospheric pressure the valve $V_6$ is closed and valve $V_7$ is opened to vent the impregnator vessel 2 to atmosphere. The effect of de-pressurising the impregnator vessel in this manner is to cause the dissociation of the liquid carbon dioxide held within the tobacco into solid carbon dioxide (dry ice) and gaseous carbon dioxide.

Following this, the impregnator top and bottom doors 5, 6 are then opened and the frozen tobacco product discharged. The frozen tobacco product is subsequently conveyed to a sublimator (not shown) which heats the frozen tobacco to cause the solid carbon dioxide to vapourise and thereby rapidly expand the tobacco. The subsequent addition of moisture then stabilizes the tobacco. Some of the liquid carbon dixode may be transferred from the drain vessel 3 to the process vessel 1 during the step when the pressure reservoir 10 is connected to the impregnator vessel 2 to empty the impregnator vessel of liquid carbon dioxide, and the remainder is then transferred from the drain vessel as described above.

The liquid carbon dioxide recovered from the impregnator vessel 2 is held in the drain vessel 3 and is transferred back to the process vessel 1 for re-use. This can be achieved either by the use of a slow speed transfer pump 9, shown in dotted outline, or by means of a differential pressure between the drain vessel 3 and process vessel 1. To achieve this, initially the higher pressure carbon dixoide gas from the pressure reservoir 10 which is introduced via a valve $V_{16}$ to the impregnator vessel 2 to displace liquid carbon dioxide can be used to raise some of the liquid carbon dioxide from the drain vessel 3 back up to the process vessel 1 via valve $V_9$. Following this, valve $V_{16}$ is closed as normal and carbon dioxide gas is introduced via a valve $V_8$ to displace the remaining liquid from the drain vessel 3 via valve $V_9$ back up to the process vessel 1. The carbon dioxide gas entering the drain vessel 3 through valve $V_8$ is also supplied from the pressure reservoir 10 which is re-charged from the carbon dioxide gas recovery compressor 9 to a specific pressure via valve $V_{10}$.

Gaseous carbon dioxide in the process vessel 1 is re-condensed using the refrigeration coil 4. Non-liquefiable air is automatically vented via valve $V_{11}$. The refrigeration coil 4 controls the pressure within the process vessel according to an equilibrium pressure selected by an operator.

Recovered carbon dioxide gas leaves the compressor 9 via valve $V_{12}$ and is re-liquefied after passing through valve $V_{13}$ by a heat exchanger 11 prior to being returned to the process vessel 1. Bypass valve $V_{14}$ and valve $V_{13}$ allows for the controlled increase in equilibrium pressure within the process vessel by the direct injection of gas should this be necessary. Alternatively, a pressure increase within the process vessel 1 could be achieved by means of an electrical heating element (not shown) fitted in the bottom section of the process vessel.

The liquid level in the process vessel can be topped up by introducing liquefied carbon dioxide via valve $V_{15}$ into the process vessel 1.

As illustrated, the process vessel 1 and drain vessel 3 are orientated in the vertical sense. This is so that tobacco products extracted by the liquid carbon dioxide remain in solution or suspension and so are not deposited on the side walls of the vessels. The liquid off-takes via valves $V_2$ and $V_9$ from the process vessel 1 and the drain vessel 3, respectively, are situated at the bottom of each of the two vessels whilst the transfer of liquid carbon dioxide into either of these two vessels is via the top of the vessel. This encourages the transfer of the tobacco products with the carbon dioxide liquid and helps to ensure the liquid carbon dioxide operates more closely to saturation conditions if it is desirable not to remove any such products from the tobacco which is being processed. Alternatively, if it is desired to remove tobacco products from the liquid carbon dioxide, this may be achieved by means of a distillation column 12 shown in dotted outline attached to the process vessel 1.

In practice, a sample from a batch of tobacco delivered to a tobacco expansion plant is analysed using standard techniques to determine the moisture content and fill volume. The equlibrium pressure within the process vessel is then selected by an operator to a "standard" value of 31 bar and a volume from the batch is loaded into the impregnator for processing. Once the expansion process is completed, a sample of the expanded tobacco is analysed, again using standard techniques, to determine the moisture content and fill volume. The pre-expansion and post-expansion fill volumes are then compared to calculate the expansion achieved and the equilibrium pressure within the process vessel for the following impregnator load is re-selected on the basis of previous test results, to optimise the tobacco expansion. If necessary, a number of impregnation cycles and expansion determinations are carried out until the optimum equilibrium pressure is found for that particular batch and subsequently the remainder of the tobacco from the batch is impregnated with liquid carbon dioxide at that pressure.

I claim:

1. A process for expanding tobacco comprising the steps of:

selecting an equilibrium pressure within a process vessel containing a mixture of gaseous carbon dioxide and liquid carbon dioxide;

charging a sample volume of tobacco from a batch of tobacco into a sealable impregnator vessel;

transferring liquid carbon dioxide at said selected equilibrium pressure from said process vessel into said impregnator vessel;

maintaining said liquid carbon dioxide in said impregnator vessel sufficiently long to permit liquefied carbon dioxide to penetrate the cells of the tobacco;

transferring liquid carbon dioxide from said impregnator vessel into a drain vessel;

reducing said pressure within the impregnator vessel sufficiently to cause the solidification of liquid carbon dioxide contained within said cells of said tobacco;

heating said tobacco sufficiently to vaporise said carbon dioxide in said tobacco cells thereby expanding said tobacco;

determining the degree of tobacco expansion obtained; and, re-selecting said equilibrium pressure within said process vessel to control the amount of solid carbon dioxide formed during the de-pressurisation step of a subsequent impregnation cycle or cycles to optimise the degree of expansion of tobacco for said remainder of the batch, wherein liquid carbon dioxide is transferred from said process vessel into said impregnator vessel under the action of gravity and subsequently liquid carbon dioxide is transferred from the impregnator vessel into said drain vessel also under the action of gravity.

2. A process according to claim 1, in which liquid carbon dioxide from within said drain vessel is returned to said process vessel for subsequent re-use by a low pressure transfer pump.

3. A process according to claim 1, in which gaseous carbon dioxide is introduced into said drain vessel to displace said liquid carbon dioxide from the drain vessel back up to said process vessel.

4. A process according to claim 3, in which a carbon dioxide reservoir provides a differential pressure required to displace liquid carbon dioxide from within said drain vessel back up to said process vessel.

5. A process according to claim 4, in which said carbon dioxide reservoir is supplied with carbon dioxide which is recovered following the venting of carbon dioxide from said impregnator vessel during said de-pressurisation step which causes the solidification of liquid carbon dioxide within said cells of said tobacco.

6. A process according to claim 5, including the step of connecting said carbon dioxide reservoir to said impregnator vessel to assist in the transfer of liquid carbon dioxide from said impregnator vessel to said drain vessel.

7. A process according to claim 4, including the step of connecting said carbon dioxide reservoir to said impregnator vessel to assist in the transfer of liquid carbon dioxide from said impregnator vessel to said drain vessel.

8. A process according to claim 1, in which the equilibrium pressure within the process vessel is controlled by refrigeration means which alters the pressure to establish said pre-selected equilibrium pressure.

9. A processing according to claim 1, in which carbon dioxide gas discharged from said impregnator vessel during said de-pressurisation step is collected within an intermediate pressure vessel which conserves said pressure of a portion of said vented gas, the remainder being discharged to a recovery balloon.

10. A process according to claim 9, in which a first compressor transfers gas from said recovery balloon to said intermediate pressure vessel and a second compressor transfers gas to a heat exchanger and re-liquefied carbon dioxide from said heat exchanger is returned to said process vessel.

11. A process according to claim 10, in which gas obtained directly from said second compressor is used to re-charge the reservoir with carbon dioxide.

12. A process according to claim 1, in which liquid carbon dioxide is always transferred via the bottom of each of said process vessel and drain vessel.

13. A process according to claim 1, which is operated within a range of pressures from 195 to 450 psi.

14. A process according to claim 1, in which liquid carbon dioxide is transferred from said process vessel to the bottom of said impregnator vessel in steps comprising:

pressurising said impregnator vessel with carbon dioxide gas from a process vessel containing an equilibrium mixture of liquefied carbon dioxide and gaseous carbon dioxide so that said impregnator vessel contains a pressurised mixture of air and carbon dioxide gas;

transferring liquid carbon dioxide into said impregnator vessel from said process vessel; and, venting said mixture of air and carbon dioxide gas from said impregnator vessel as the level of liquid carbon dioxide within said impregnator vessel rises.

15. A process according to claim 14, in which said mixture of carbon dioxide and air is vented to a gas recovery system which recovers carbon dioxide and vents non-liquefiable air to atmosphere.

16. A process according to claim 14, in which said mixture of carbon dioxide and air is vented directly to said process vessel and non-liquefiable air is automatically vented to atmosphere from said process vessel.

17. An apparatus for expanding tobacco comprising:

a process vessel containing an equilibrium mixture of liquid carbon dioxide and gaseous carbon dioxide;

an impregnator vessel having a sealable top lid for charging tobacco into the impregnator vessel and a sealable bottom lid for discharging tobacco from the impregnator vessel;

means providing fluid communication between a gas phase within said process vessel and said impregnator vessel;

means providing fluid communication between a liquid phase within said process vessel and said impregnator vessel, wherein liquid carbon dioxide is transferred from said process vessel into said impregnator vessel under the action of gravity;

a drain vessel;

means providing fluid communication between said impregnator vessel and said drain vessel for transferring liquid carbon dioxide from the impregnator vessel to said drain vessel Under action of gravity; means providing fluid communication between said drain vessel and said process vessel for transferring liquid carbon dioxide from said drain vessel to said process vessel;

means for selecting an equilibrium pressure within said process vessel; and, means for controlling a pressure within said process vessel to establish said selected equilibrium pressure.

18. An apparatus according to claim 17, in which both said process vessel and said drain vessel are generally cylindrical in shape with a conical base portion and are oriented in the vertical sense and each said vessel includes means for transferring liquid carbon dioxide via the bottom of each vessel.

* * * * *